US008334746B2

(12) United States Patent
Matsushita

(10) Patent No.: US 8,334,746 B2
(45) Date of Patent: Dec. 18, 2012

(54) ELECTRONIC COMPONENT

(75) Inventor: Yosuke Matsushita, Nagaokakyo (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 76 days.

(21) Appl. No.: 12/987,198

(22) Filed: Jan. 10, 2011

(65) Prior Publication Data

US 2011/0102124 A1 May 5, 2011

Related U.S. Application Data

(63) Continuation of application No. PCT/JP2009/061335, filed on Jun. 22, 2009.

(30) Foreign Application Priority Data

Jul. 15, 2008 (JP) ..... 2008-183626

(51) Int. Cl.
*H01F 5/00* (2006.01)

(52) U.S. Cl. ..... 336/200

(58) Field of Classification Search ..... 336/65, 336/83, 192, 200, 232
See application file for complete search history.

(56) References Cited

FOREIGN PATENT DOCUMENTS

| | | | |
|---|---|---|---|
| JP | 3-88309 | U | 9/1991 |
| JP | 9-63848 | A | 3/1997 |
| JP | 10-270249 | A | 10/1998 |
| JP | 2000-216023 | A | 8/2000 |
| JP | 2000-348940 | A | 12/2000 |

OTHER PUBLICATIONS

Official Communication issued in International Patent Application No. PCT/JP2009/061335, mailed on Sep. 29, 2009.

*Primary Examiner* — Tuyen Nguyen
(74) *Attorney, Agent, or Firm* — Keating & Bennett, LLP

(57) ABSTRACT

In an electronic component, a multilayer body includes a plurality of insulator layers stacked on top of one another. A first coil is provided in the multilayer body, includes a first coil axis and extends toward the positive side in the z-axis direction while circling counterclockwise around the first coil axis. A second coil is connected to the first coil, is provided in the multilayer body, includes a second coil axis, and extends toward the negative side in the z-axis direction while circling counterclockwise around the second coil axis. When viewed in plan from the z-axis direction, the first coil axis is disposed inside the second coil and the second coil axis is disposed inside the first coil.

5 Claims, 7 Drawing Sheets

ELECTRONIC COMPONENT

BACKGROUND OF THE INVENTION

1. Field of the Invention

The present invention relates to electronic components, and more particularly, to electronic components including built-in coils.

2. Description of the Related Art

The multilayer coil component described in Japanese Unexamined Patent Application Publication No. 10-270249 is a known example of an existing electronic component. In this multilayer coil component, a multilayer body having a rectangular parallelepiped shape is formed of a plurality of insulating green sheets stacked on top of one another. Coil conductors are provided on the plurality of insulating green sheets. The coil conductors are connected to one another through via holes, thereby forming a helical coil. Furthermore, two terminal electrodes are arranged so as to cover two side surfaces of the multilayer body and the helical coil is connected to two terminal electrodes.

In the multilayer coil component described in Japanese Unexamined Patent Application Publication No. 10-270249, the terminal electrodes are arranged so as to cover the side surfaces of the multilayer body and, therefore, are arranged side by side with and close to each of the coil conductors in a direction perpendicular to the stacking direction. Consequently, floating capacitances occur between the coil conductors and the terminal electrodes. When such floating capacitances occur, there is a problem in that the resonant frequency of the coil is decreased and the Q value at a frequency at which the coil is to be used is decreased. Therefore, the generation of floating capacitances in multilayer coil components decreases the Q values of electronic components that include built-in coils.

An electronic component 500 including a land grid array (LGA) structure illustrated in FIG. 7 is an example of an electronic component that is capable of suppressing the generation of floating capacitances. FIG. 7 is an exploded perspective view of the electronic component 500. Hereafter, the stacking direction of the electronic component 500 is defined as a z-axis direction, a direction in which longer edges of the electronic component 500 extend is defined as an x-axis direction, and a direction in which shorter edges of the electronic component 500 extend is defined as a y-axis direction. The x-axis, the y-axis, and the z-axis are orthogonal to one another.

The electronic component 500 includes a multilayer body 502, external electrodes 506*a* and 506*b*, and coils L501 and L502. The multilayer body 502 includes rectangular insulator layers 504*a* to 504*i* that are stacked on top of one another. Coil electrodes 508*a* to 508*e* provided on the insulator layers 504*d* to 504*h* are connected to one another through via hole conductors B thereby forming the coil L501. Furthermore, coil electrodes 510*a* to 510*e* provided on the insulator layers 504*d* to 504*h* are connected to one another through the via hole conductors B, thereby forming the coil L502. In addition, the coil electrode 508*a* and the coil electrode 510*a* are connected to each other, and thereby the coil L501 and the coil L502 are connected to each other.

Furthermore, the external electrodes 506*a* and 506*b* are provided on a surface of the multilayer body 502 on the negative side in the z-axis direction and are respectively connected to the coil electrodes 508*e* and 510*e* through the via hole conductors B. In the electronic component 500, the external electrodes 506*a* and 506*b* are provided on a surface of the multilayer body 502 on the negative side in the z-axis direction and, therefore, are not close to or side by side with the coil electrodes 508*a* to 508*d* and 510*a* to 510*d*. Therefore, a decrease in the Q value of the electronic component 500 due to the generation of floating capacitances between the external electrodes 506*a* and 506*b*, and the coil electrodes 508*a* to 508*d* and 510*a* to 510*d* is prevented.

However, there is a problem with the electronic component 500 illustrated in FIG. 7 in that it is difficult to obtain a high Q value. In more detail, in the electronic component 500, the coil electrodes 508 and 510 are arranged so as to be side by side on the same insulator layers 504. Consequently, in the electronic component 500, the inner diameters of the coil electrodes 508 and 510 are smaller than when a single coil electrode is provided on an insulator layer. Thus, if the inner diameters of the coil electrodes 508 and 510 are smaller, the amounts of magnetic flux passing through the inside of the coil electrodes 508 and 510 are also smaller and the inductance values of the coils L501 and L502 are decreased. Consequently, in order to obtain a desired inductance value, it is necessary to increase the lengths of the coil electrodes 508 and 510. However, if the lengths of the coil electrodes 508 and 510 are increased, the resistance is increased and the Q value is decreased.

In addition, an electronic component in which two coils are arranged in parallel with each other as illustrated in FIG. 7 is disclosed, for example, in Japanese Unexamined Patent Application Publication No. 9-63848. However, in the multilayer inductor disclosed in Japanese Unexamined Patent Application Publication No. 9-63848, two coils are arranged in parallel with each other and, therefore, the same problem as that described with respect to the electronic component 500 illustrated in FIG. 7 occurs. Furthermore, since external electrodes are provided on side surfaces of the multilayer body, the multilayer inductor described in Japanese Unexamined Patent Application Publication No. 9-63848 also has the problem of the Q value being decreased due to the increased floating capacitance.

SUMMARY OF THE INVENTION

To overcome the problems described above, preferred embodiments of the present invention provide an electronic component that has a high inductance value and a high Q value.

An electronic component according to a preferred embodiment of the present invention provides an electronic component including a multilayer body that includes a plurality of insulator layers that are stacked on top of one another, a first coil that is provided in the multilayer body, includes a first coil axis, and extends in a first direction while circling in a predetermined direction around the first coil axis, and a second coil that is connected to the first coil, is provided in the multilayer body, includes a second coil axis, and extends in a second direction, which is a direction opposite to the first direction, while circling in the predetermined direction around the second coil axis. When viewed in plan from the first direction, the first coil axis is arranged inside the second coil, and when viewed in plan from the second direction, the second coil axis is arranged inside the first coil.

With various preferred embodiments of the present invention, a high inductance value and a high Q value are obtained.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereafter, electronic components according to preferred embodiments of the present invention will be described with reference to the drawings.

First Preferred Embodiment

Figure 1:
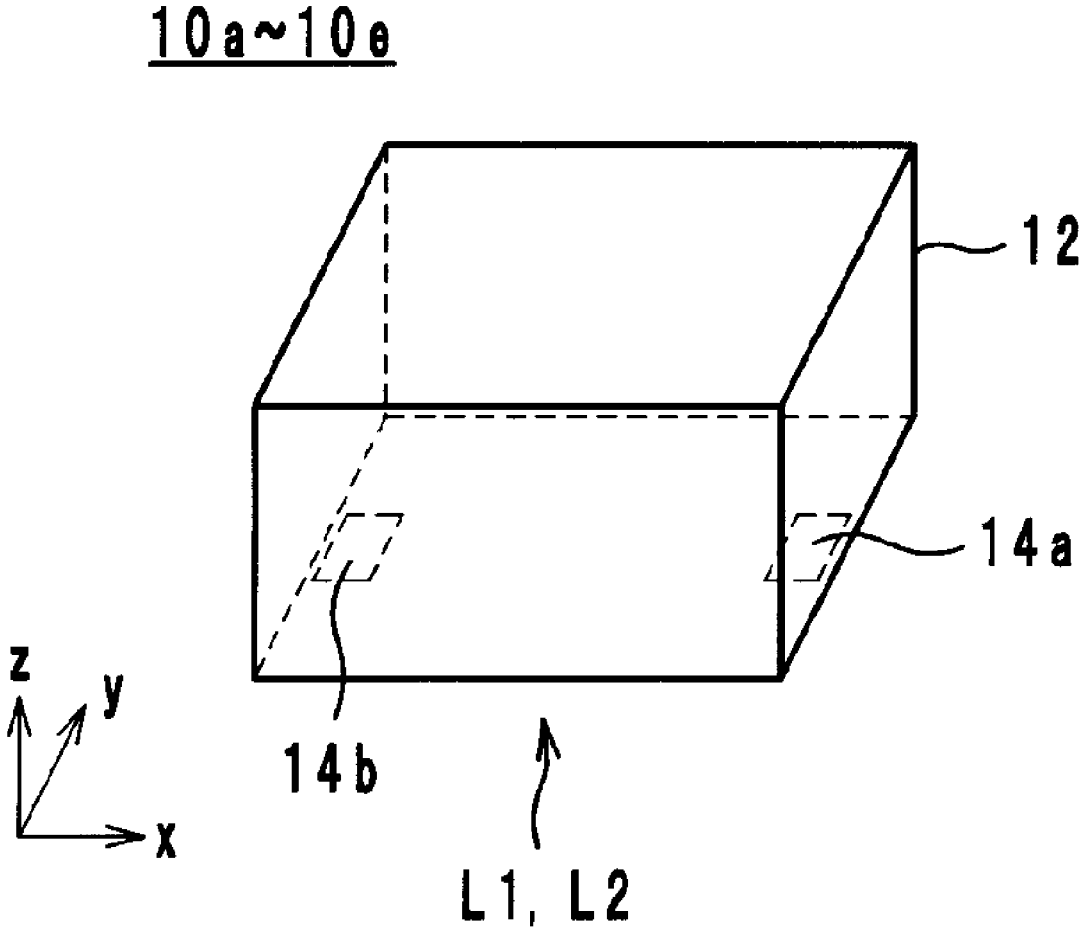
FIG. 1 is an external perspective view of an electronic component according to any of first to fifth preferred embodiments of the present invention.
Figure 2:
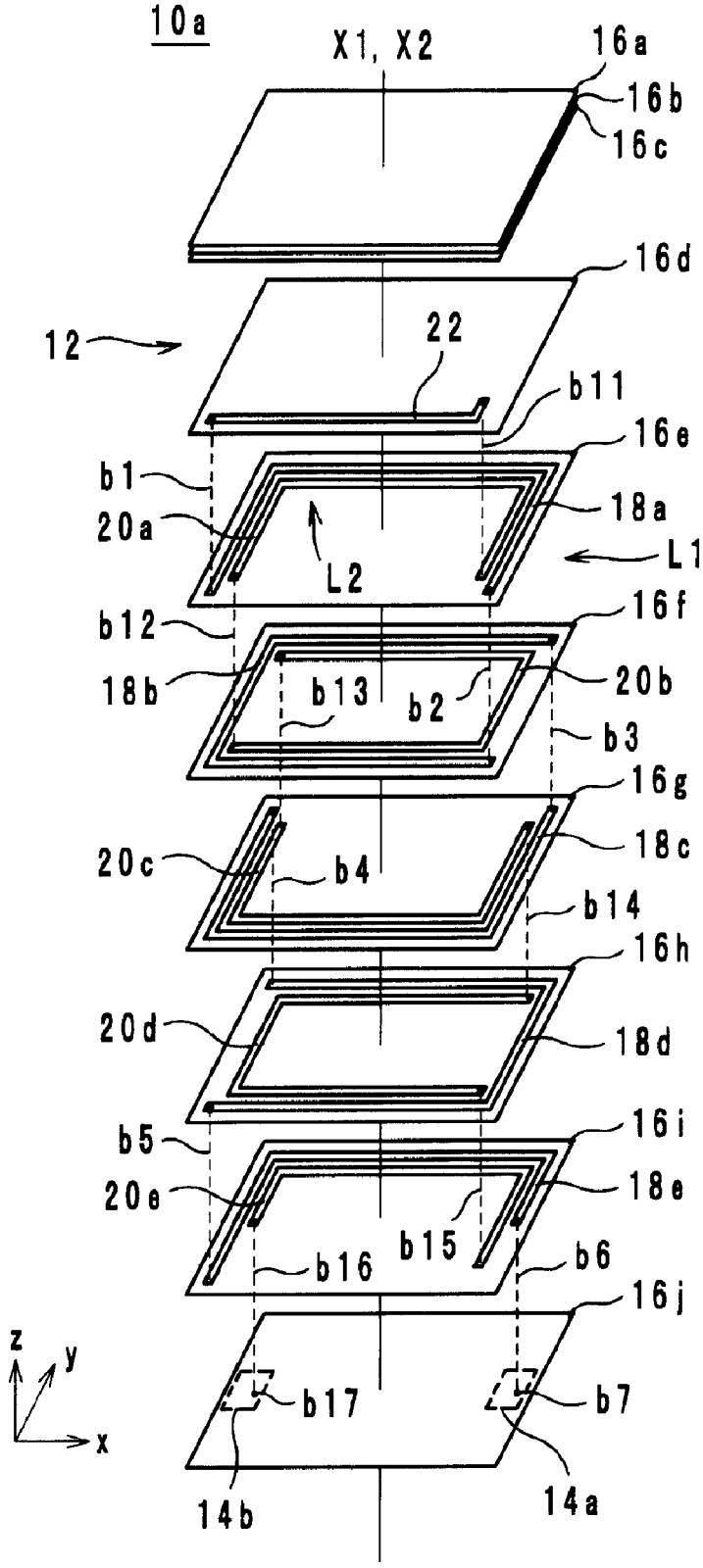
FIG. 2 is an exploded perspective view of an electronic component according to a first preferred embodiment of the present invention.

FIG. 1 is an external perspective view of an electronic component 10*a* according to a first preferred embodiment of the present invention. FIG. 2 is an exploded perspective view of the electronic component 10*a* according to the first preferred embodiment of the present invention. Hereafter, the stacking direction of the electronic component 10*a* is defined as a z-axis direction, a direction in which longer edges of the electronic component 10*a* extend is defined as an x-axis direction, and a direction in which shorter edges of the electronic component 10*a* extend is defined as a y-axis direction. The x-axis, the y-axis, and the z-axis are orthogonal to one another.

As illustrated in FIG. 1, the electronic component 10*a* includes a multilayer body 12 and external electrodes 14*a* and 14*b*. The multilayer body 12 preferably has a substantially rectangular parallelepiped shape and includes coils L1 and L2 provided therein, for example. The external electrode 14*a* is electrically connected to one end of the coil L1 and is disposed on a surface of the multilayer body 12 that faces toward the negative side in the z-axis direction. The external electrode 14*b* is preferably electrically connected to one end of the coil L2 and is disposed on the bottom surface of the multilayer body 12 arranged on the negative side in the z-axis direction.

As illustrated in FIG. 2, the multilayer body 12 includes a plurality of insulator layers 16*a* to 16*j* that are stacked on top of one another in order from the top in the z-axis direction. The insulator layers 16*a* to 16*j* are preferably rectangular insulator layers made of, for example, a ferromagnetic ferrite (for example, a Ni—Zn—Cu ferrite or a Ni—Zn ferrite). Alternatively, dielectric layers, for example, may be used as the insulator layers 16*a* to 16*j*.

As illustrated in FIG. 2, the coil L1 preferably includes coil electrodes 18*a* to 18*e* and via hole conductors b2 to b6 and is preferably a helical coil having a coil axis X1 that is parallel or substantially parallel to the z-axis and passes through the approximate centers (intersections of diagonals) of the insulator layers 16*a* to 16*j*. When viewed in plan from the positive side in the z-axis direction, the coil L1 extends from the negative side to the positive side in the z-axis direction while circling counterclockwise around the coil axis X1.

As illustrated in FIG. 2, the coil electrodes 18*a* to 18*e* are preferably respectively provided on main surfaces of the insulator layers 16*d* to 16*i* from a conductive material, such as Ag, Cu or other suitable conductive material, for example. Preferably, each of the coil electrodes 18*a* to 18*e* has a length of about ¾ of a turn and, when viewed in plan from the z-axis direction, are superposed with one another to thereby define a substantially rectangular region.

The via hole conductors b2 to b6 are respectively arranged so as to penetrate through the insulator layers 16*e* to 16*i* in the z-axis direction. The via hole conductors b2 to b6 are respectively arranged so as to be connected to end portions of the coil electrodes 18*a* to 18*e* disposed on the counterclockwise upstream side, when viewed in plan from the positive side in the z-axis direction. Furthermore, the via hole conductors b2 to b5 are preferably connected to end portions of the coil electrodes 18*b* to 18*e*, which are arranged on the insulator layers 16*f* to 16*i* on the negative side in the z-axis direction, the end portions being disposed on the counterclockwise downstream side. The coil electrodes 18*a* to 18*e* and via hole conductors b2 to b6 are preferably connected to one another such that the coil L1 extends from the negative side to the positive side in the z-axis direction while circling counterclockwise around the coil axis X1 when viewed in plan from the positive side in the z-axis direction.

As illustrated in FIG. 2, preferably, the coil L2 includes coil electrodes 20*a* to 20*e* and via hole conductors b12 to b16, and is a helical coil having a coil axis X2 that is parallel or substantially parallel to the z-axis and passes through the approximate centers (intersections of diagonals) of the insulator layers 16*a* to 16*j*. The coil L2 preferably extends from the positive side to the negative side in the z-axis direction while circling counterclockwise around the coil axis X2 when viewed in plan from the positive side in the z-axis direction. Furthermore, the region through which the coil L2 extends is preferably superposed with the region through which the coil L1 extends in the z-axis direction.

As illustrated in FIG. 2, the coil electrodes 20*a* to 20*e* are preferably respectively provided on main surfaces of the insulator layers 16*d* to 16*i*, on which the coil electrodes 18*a* to 18*e* are provided, and preferably made of a conductive material such as Ag, Cu or other suitable conductive material, for example. Preferably, each of the coil electrodes 20*a* to 20*e* has a length of ¾ of a turn and when viewed in plan from the z-axis direction are superposed with one another to thereby define the inside of a substantially rectangular-ring-shaped region inside the rectangular region defined by the coil electrodes 18*a* to 18*e*. Thus, the coil L2 is contained within the coil L1. Furthermore, when viewed in plan from the z-axis direction, the coil axis X1 of the coil L1 is preferably disposed inside the coil L2 and the coil axis X2 of the coil L2 is disposed inside the coil L1. In addition, the coil electrodes 18*a* to 18*e* and the coil electrodes 20*a* to 20*e* are preferably provided on the main surfaces of the insulator layers 16*d* to 16*i* and, therefore, the region through which the coil L2 extends is superposed with the region through which the coil L1 extends in the z-axis direction.

Furthermore, in the first preferred embodiment, the respective edges of the substantially rectangular region defined by the coil electrodes 18*a* to 18*e* and the respective edges of the substantially rectangular region defined by the coil electrodes 20*a* to 20*e* are arranged substantially in parallel to one another with a uniform space therebetween, for example. Therefore, the location of the coil axis X1 and the location of the coil axis X2 coincide with each other.

The via hole conductors b12 to b16 are preferably respectively arranged so as to penetrate through the insulator layers 16*e* to 16*j* in the z-axis direction. The via hole conductors b12 to b16 are preferably respectively arranged so as to be connected to end portions of the coil electrodes 20*a* to 20*e* located on the counterclockwise downstream side, when viewed in plan from the positive side in the z-axis direction. Furthermore, the via hole conductors b12 to b15 are preferably connected to end portions of the coil electrodes 20*b* to 20*e* provided on the insulator layers 16*f* to 16*i* located on the negative side in the z-axis direction, the end portions being disposed on the counterclockwise upstream side. The coil electrodes 20*a* to 20*e* and via hole conductors b12 to b16 are connected to one another, whereby the coil L2 extends from the positive side to the negative side in the z-axis direction (opposite direction to direction in which coil L1 extends) while circling counterclockwise around the coil axis X2, when viewed in plan from the positive side in the z-axis direction.

Furthermore, the coil L1 and the coil L2 are preferably connected to each other through a connection electrode 22 provided on the insulator layer 16*d* and via hole conductors b1 and b11. Specifically, the via hole conductors b1 and b11 are arranged so as to be connected to the two ends of the connection electrode 22. Furthermore, the via hole conductors b1 and b11 are respectively connected to the coil electrodes 18*a* and 20*a*. Thus, an end portion of the coil L1 located on the positive side in the z-axis direction and an end portion of the coil L2 located on the positive side in the z-axis direction are preferably connected to each other.

In addition, the external electrodes 14*a* and 14*b* are provided on the surface of the insulator layer 16*j* on the negative side in the z-axis direction. Furthermore, preferably, via hole conductors b7 and b17 are arranged so as to penetrate through the insulator layer 16*j* in the z-axis direction and are respectively connected to the external electrodes 14*a* and 14*b*. The via hole conductors b7 and b17 are respectively connected to the via hole conductors b6 and b16 when the insulator layers 16*i* and 16*j* are stacked one on top of the other. Thus, an end portion of the coil L1 disposed on the negative side in the z-axis direction is preferably connected to the external electrode 14*a* and an end portion of the coil L2 disposed on the negative side in the z-axis direction is preferably connected to the external electrode 14*b*.

As described below, the electronic component 10*a* is capable of obtaining both a high inductance value and a high Q value. In more detail, as illustrated in FIG. 2, the coil L1 extends from the negative side to the positive side in the z-axis direction while circling counterclockwise around the coil axis X1 when viewed in plan from the positive side in the z-axis direction, and the coil L2 extends from the positive side to the negative side in the z-axis direction while circling counterclockwise around the coil axis X2 when viewed in plan from the positive side in the z-axis direction. Consequently, when a current flows between the external electrode 14*a* and the external electrode 14*b*, the direction in which the current flowing through the coil L1 circles and the direction in which the current flowing through the coil L2 circles correspond to each other when viewed in plan from the positive side in the z-axis direction. For example, when a current flows from the external electrode 14*a* to the external electrode 14*b*, the current flows counterclockwise through the coil electrodes 18*a* to 18*e* and 20*a* to 20*e* when viewed in plan from the positive side in the z-axis direction. In this case, magnetic flux is generated from the negative side to the positive side in the z-axis direction inside the coil L1. Similarly, magnetic flux is also generated from the negative side to the positive side in the z-axis direction inside the coil L2. Thus, the magnetic flux generated by the coil L1 and the magnetic flux generated by the coil L2 pass through the inside of each of the coil L1 and the coil L2. As a result, the coil L1 in this preferred embodiment can obtain a larger inductance value than in the case in which only the magnetic flux generated by the coil L1 passes through the inside of the coil L1. Similarly, the coil L2 in this preferred embodiment can obtain a larger inductance value than in the case in which only the magnetic flux generated by the coil L2 passes through the inside of the coil L2. As a result, a high inductance value is obtained with the electronic component 10*a*.

Figure 7:
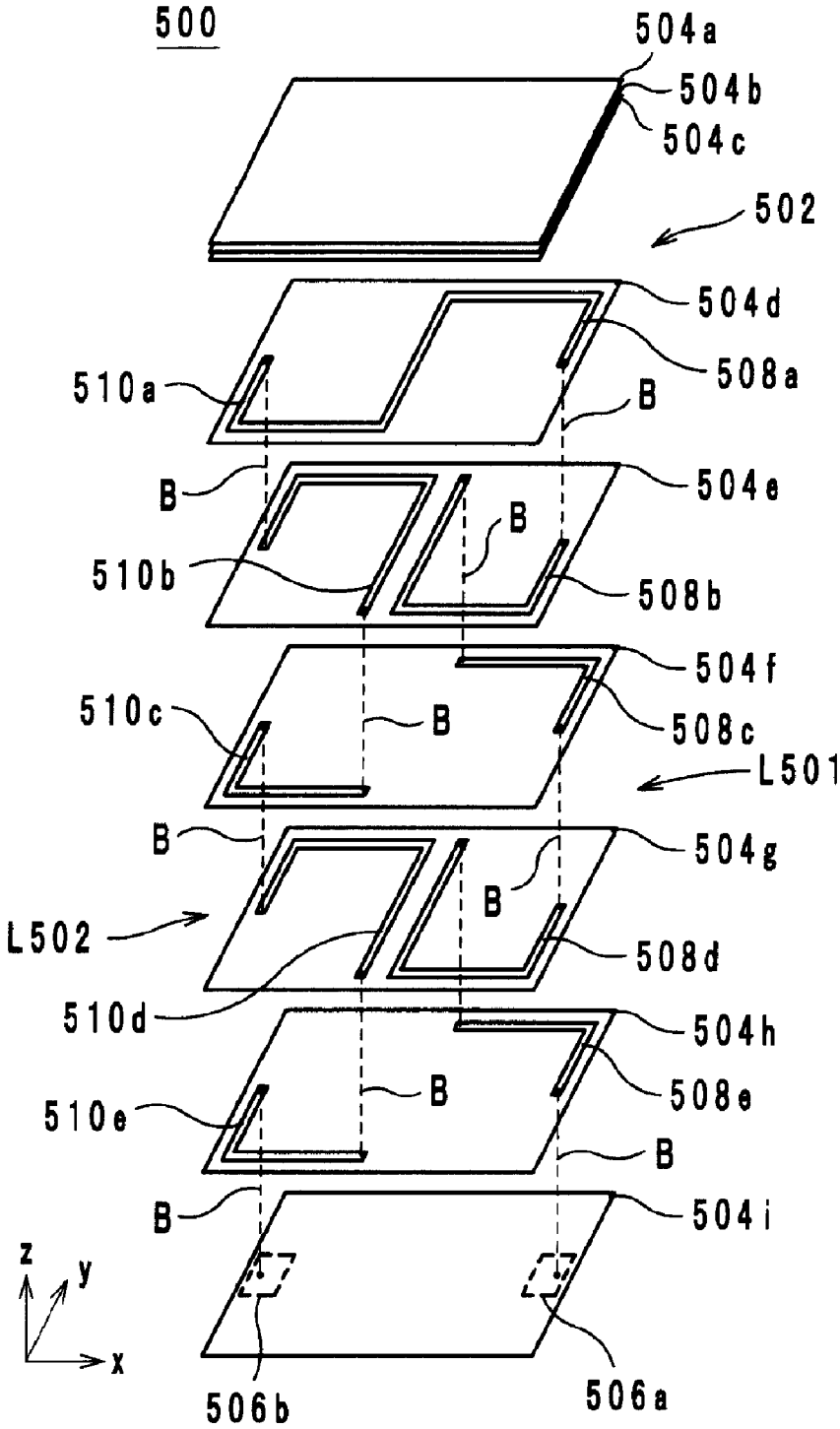
FIG. 7 PRIOR ART
FIG. 7 is an exploded perspective view of a known electronic component.

Furthermore, as will be described below, the electronic component 10*a* also obtains a high Q value. In more detail, in the electronic component 500, as illustrated in FIG. 7, the coil L501 and the coil L502 are arranged so as to be side by side and not superposed with each other when viewed in plan from the z-axis direction. Accordingly, in the electronic component 500, it is difficult to increase the internal diameters of the coils L501 and L502, and it is difficult to increase the amount of magnetic flux passing through the insides of the coils L501 and L502. As a result, it is difficult to obtain a high Q value with the coils L501 and L502.

In contrast, in the electronic component 10*a*, the coil axis X1 of the coil L1 is disposed inside the coil L2 and the coil axis X2 of the coil L2 is disposed inside the coil L1. Therefore, the coil L1 and the coil L2 are superposed with each other when viewed in plan from the z-axis direction. Thus, the inner diameters of the coil electrodes 18*a* to 18*e* and 20*a* to 20*e* are greater than the inner diameters of the coil electrodes 508*a* to 508*e* and 510*a* to 510*e* of the electronic component 500 and, therefore, the amount of magnetic flux passing through the insides of the coils L1 and L2 is greater than the amount of magnetic flux passing through the insides of the coils L501 and L502. As a result, with the coils L1 and L2, both a higher inductance value and a higher Q value are obtained than with the coils L501 and L502.

In addition, in the electronic component 10*a*, the external electrodes 14*a* and 14*b* are preferably provided on the bottom surface of the multilayer body 12 disposed on the negative side in the z-axis direction. Consequently, the floating capacitances generated between the external electrodes 14*a* and 14*b* and the coils L1 and L2 in the electronic component 10*a* are less than in the multilayer coil component described in Japanese Unexamined Patent Application Publication No. 10-270249 in which terminal electrodes are arranged on side surfaces of the multilayer body. As a result, the Q value of the electronic component 10*a* is further improved.

Furthermore, in the electronic component 10*a*, the coil axis X1 and the coil axis X2 are preferably superposed with each other and, therefore, the distribution of the magnetic flux that passes through the inside of the coil L1 and the distribution of the magnetic flux that passes through the inside of the coil L2 are approximately the same. As a result, canceling out of the magnetic flux generated by the coil L1 and the magnetic flux generated by the coil L2 is reduced and both a high inductance value and a high Q value is obtained with the electronic component 10*a*.

Furthermore, in the electronic component 10*a*, the coil electrodes 18*a* to 18*e* and the coil electrodes 20*a* to 20*e* are preferably provided on the same insulator layers 16*e* to 16*i*. Consequently, there are fewer insulator layers 16 in the electronic component 10*a* than if the coil electrodes 18*a* to 18*e* and the coil electrodes 20*a* to 20*e* are provided on separate insulator layers 16. As a result, the size of the electric component 10*a* is significantly reduced.

Hereafter, a method of manufacturing the electronic component 10*a* will be described with reference to FIG. 1 and FIG. 2.

First, ceramic green sheets that will become the insulator layers 16*a* to 16*j* are prepared. The via hole conductors b1 to b7 and b11 to b17 are formed in the respective ceramic green sheets that will become the insulator layers 16*d* to 16*j*. Specifically, as illustrated in FIG. 2, via holes are preferably formed in the ceramic green sheets that will become the insulator layers 16*d* to 16*j* by performing irradiation with a laser beam, for example. Next, the via holes are filled with a conductive paste preferably made of Ag, Pd, Cu, Au, an alloy of any of these metals, or other suitable conductive paste using a method such as print coating, for example.

Next, the coil electrodes 18*a* to 18*e* and 20*a* to 20*e* are formed on the ceramic green sheets that will become the insulator layers 16*e* to 16*i* preferably by coating a conductive paste including a main component of Ag, Pd, Cu, Au, an alloy of any of these metals, or other suitable conductive paste using a method, such as a screen printing method or a photolithography method, for example. In addition, the step of forming the coil electrodes 18*a* to 18*e* and 20*a* to 20*e* and the step of filling the via holes with conductive paste may preferably be performed in the same step.

Next, the connection electrode 22 is formed by coating a conductive paste including Ag, Pd, Cu, Au, an alloy of any of these metals, or other suitable conductive paste as a main component on the ceramic green sheet that will become the insulator layer 16*d* using a method, such as a screen printing method or a photolithography method, for example. In addition, the step of forming the connection electrode 22 and the step of filling the via holes with conductive paste may preferably be performed in the same step.

Next, silver electrodes, for example, that will become the external electrodes 14*a* and 14*b* are preferably formed on the ceramic green sheet that will become the insulator layer 16*j* by coating a conductive paste including Ag, Pd, Cu, Au, an alloy of any of these metals, or other suitable conductive paste as a main component using a method, such as a screen printing method or a photolithography method, for example. In addition, the step of forming the silver electrodes that will become the external electrodes 14*a* and 14*b* and the step of filling the via holes with conductive paste may preferably be performed in the same step.

Next, as illustrated in FIG. 2, the ceramic green sheets that will become the insulator layers 16*a* to 16*j* are preferably stacked on top of one another. In more detail, the ceramic green sheet that will become the insulator layer 16*j* is arranged so that the surface thereof on which the silver electrodes that will become the external electrodes 14*a* and 14*b* have been provided is disposed on the negative side in the z-axis direction. Next, the ceramic green sheet that will become the insulator layer 16*i* is arranged on top of and provisionally press bonded to the ceramic green sheet that will become the insulator layer 16*j*. Then, a mother multilayer body is obtained by similarly stacking and provisionally press bonding together the ceramic green sheets that will become the insulator layers 16*h*, 16*g*, 16*f*, 16*e*, 16*d*, 16*c*, 16*b*, and 16*a* in this order. Then, the mother multilayer body is preferably permanently press bonded using a hydrostatic press or other suitable apparatus or method, for example.

Next, division grooves are preferably formed in the mother multilayer body. The yet-to-be-fired mother multilayer body is preferably subjected to debinding processing and firing, for example. The debinding processing is, for example, performed under conditions of about 500° C. for about two hours in a low oxygen atmosphere. The firing is, for example, performed under conditions of about 890° C. for about two hours. Then, the multilayer body 12 is obtained by dividing the mother multilayer body along the division grooves.

The fired multilayer body 12 is preferably obtained by performing the above-described steps. The multilayer body 12 is then preferably subjected to barrel polishing and chamfering, for example. Finally, the surfaces of the silver electrodes that will become the external electrodes 14*a* and 14*b* are preferably subjected to Ni plating or Sn plating, for example. Through the above-described steps, the electronic component 10*a* illustrated in FIG. 1 is produced.

In addition, the electronic component 10*a* according to the first preferred embodiment is preferably manufactured using a sequential press bonding method. However, the method of manufacturing the electronic component 10*a* is not limited to this. The electronic component 10*a*, for example, may be manufactured using a thin film method. In this case, dielectric layers made of a resin are preferably used as the insulator layers 16.

Second Preferred Embodiment

Figure 3:
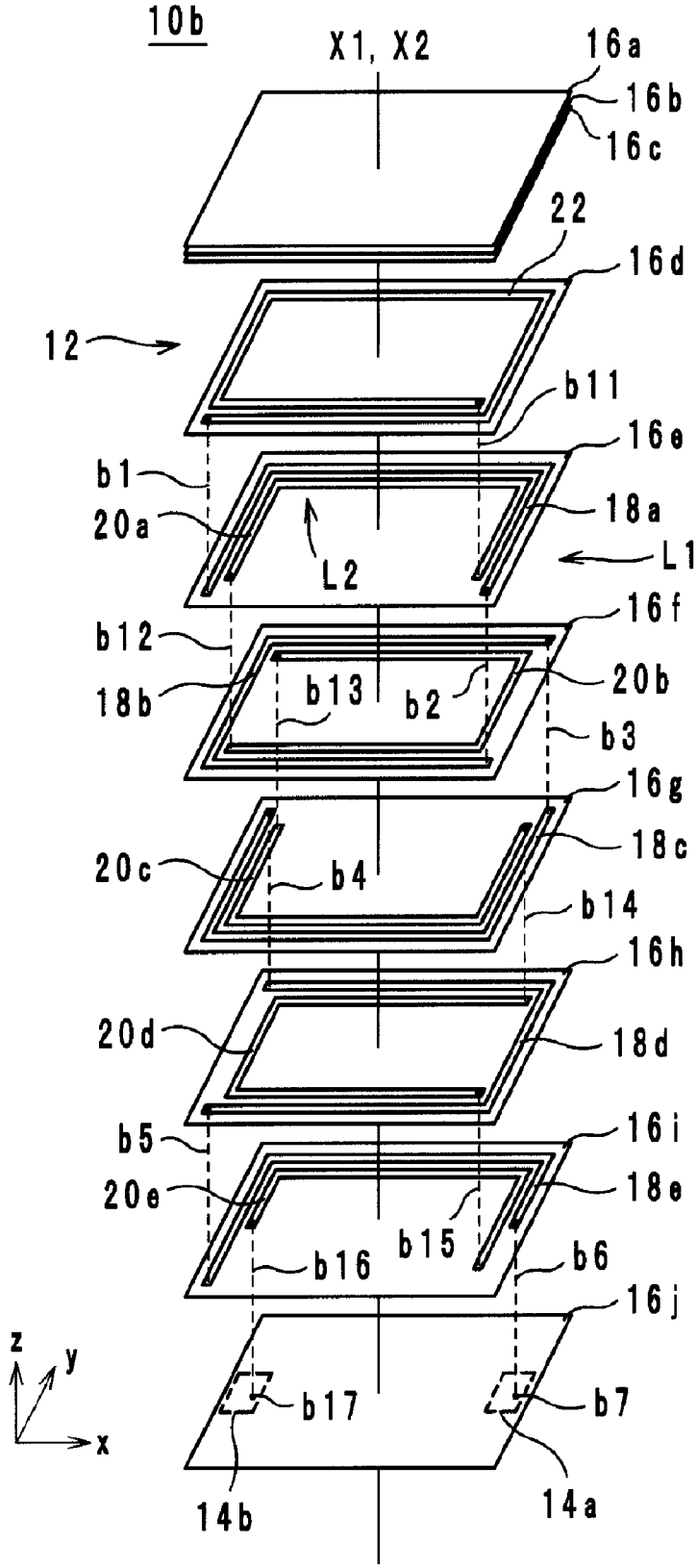
FIG. 3 is an exploded perspective view of an electronic component according to a second preferred embodiment of the present invention.

Hereafter, an electronic component 10*b* according to a second preferred embodiment of the present invention will be described with reference to the drawings. FIG. 3 is an exploded perspective view of the electronic component 10*b* according to the second preferred embodiment. Hereafter, the stacking direction of the electronic component 10*b* is defined as a z-axis direction, a direction in which longer edges of the electronic component 10*b* extend is defined as an x-axis direction, and a direction in which shorter edges of the electronic component 10*b* extend is defined as a y-axis direction. The x-axis, the y-axis, and the z-axis are orthogonal to one another. Furthermore, FIG. 1 shows an external perspective view of the electronic component 10*b*.

As illustrated in the electronic component 10*b*, the connection electrode 22 may preferably circle around the coil axes X1 and X2. As a result of the connection electrode 22 circling around the coil axes X1 and X2 in this manner, a higher inductance value and a higher Q value are obtained with the electronic component 10*b* than with the electronic component 10*a* in which the connection electrode 22 does not circle around the coil axes X1 and X2. The remaining structure of the electronic component 10*b* is preferably the same or substantially the same as that of the electronic component 10*a* and therefore description thereof is omitted.

Third Preferred Embodiment

Figure 4:
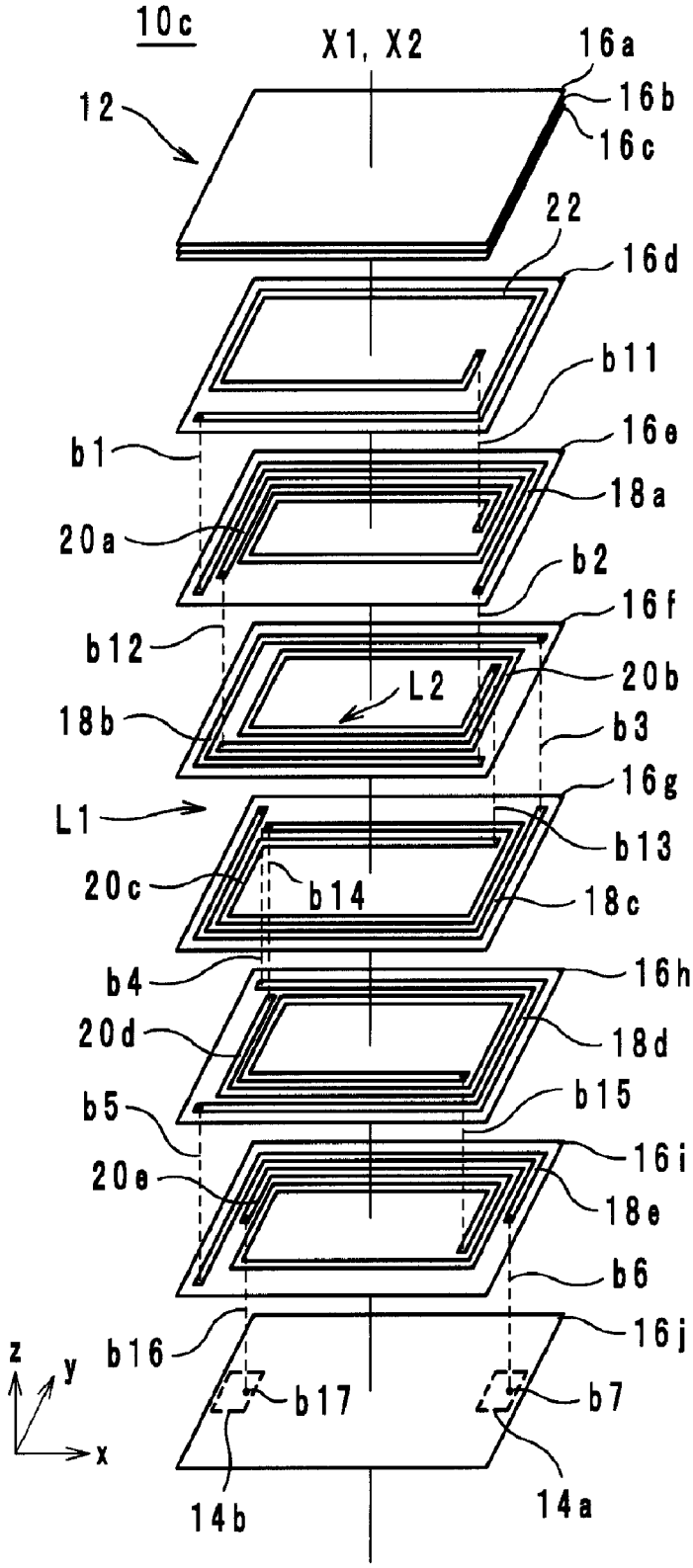
FIG. 4 is an exploded perspective view of an electronic component according to a third preferred embodiment of the present invention.

Hereafter, an electronic component 10*c* according to a third preferred embodiment of the present invention will be described with reference to the drawings. FIG. 4 is an exploded perspective view of the electronic component 10*c* according to the third preferred embodiment. Hereafter, the stacking direction of the electronic component 10*c* is defined as a z-axis direction, a direction in which longer edges of the electronic component 10*c* extend is defined as an x-axis direction, and a direction in which shorter edges of the electronic component 10*c* extend is defined as a y-axis direction. The x-axis, the y-axis, and the z-axis are orthogonal to one another. Furthermore, FIG. 1 shows an external perspective view of the electronic component 10*c*.

As illustrated in the electronic component 10*c*, each of the coil electrodes 20*a* to 20*e* that define the coil L2 preferably have a length of a plurality of turns. Thus, the amount of magnetic flux generated around the individual coil electrodes 20*a* to 20*e* in the electronic component 10*c* is increased and the amount of magnetic flux passing through the insides of the coils L1 and L2 in the electronic component 10*c* is increased, as compared to the case in which each of the coil electrodes 20*a* to 20*e* has a length of about ¾ of a turn as in the electronic component 10*a*. As a result, a higher inductance value and a higher Q value are obtained with the electronic component 10*c* than with the electronic component 10*a*.

Fourth Preferred Embodiment

Figure 5:
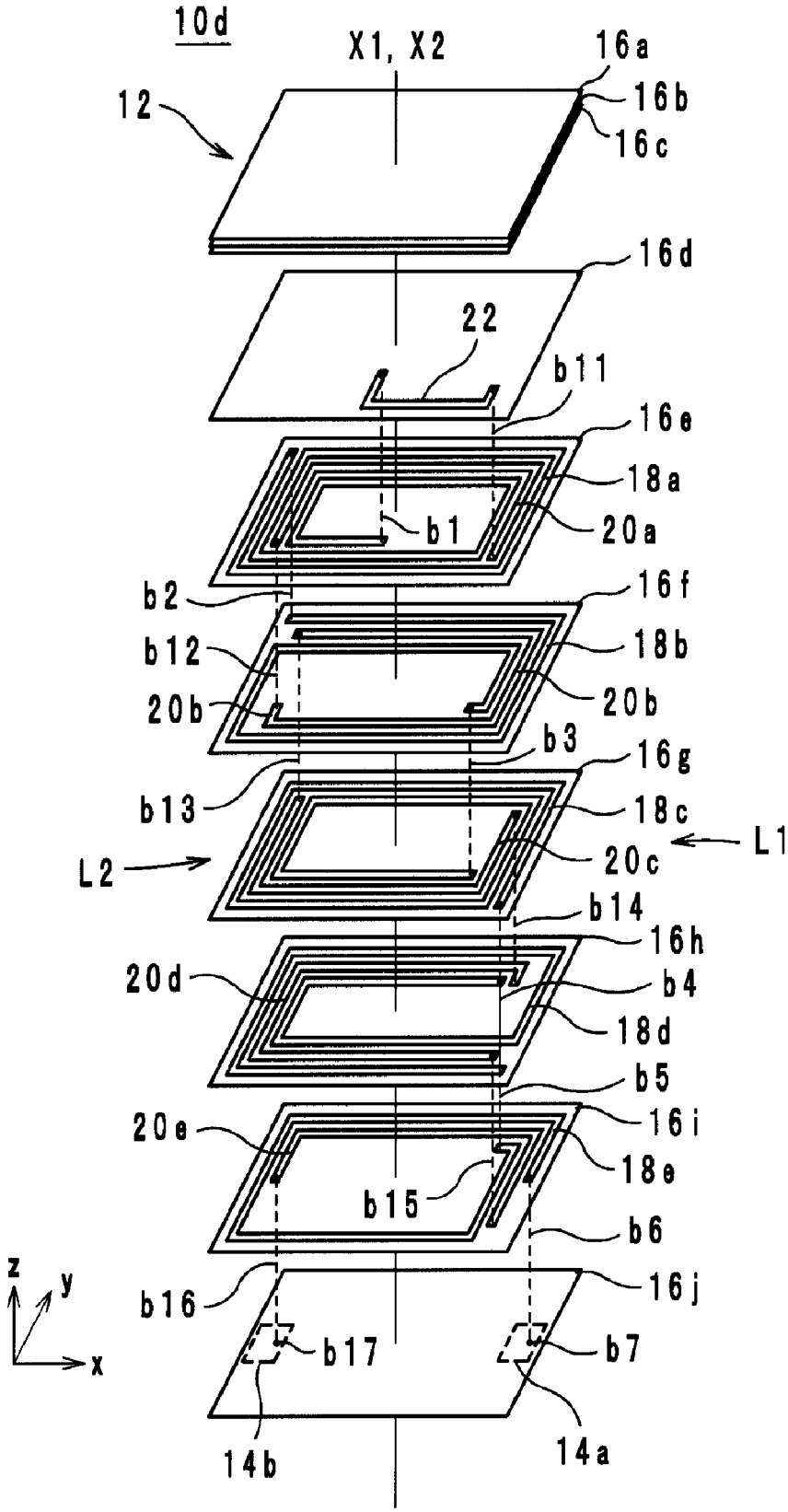
FIG. 5 is an exploded perspective view of an electronic component according to a fourth preferred embodiment of the present invention.

Hereafter, an electronic component 10*d* according to a fourth preferred embodiment of the present invention will be described with reference to the drawings. FIG. 5 is an exploded perspective view of the electronic component 10*d* according to the fourth preferred embodiment. Hereafter, the stacking direction of the electronic component 10*d* is defined as a z-axis direction, a direction in which longer edges of the electronic component 10*d* extend is defined as an x-axis direction, and a direction in which shorter edges of the electronic component 10*d* extend is defined as a y-axis direction. The x-axis, the y-axis, and the z-axis are orthogonal to one another. Furthermore, FIG. 1 shows an external perspective view of the electronic component 10*d*.

As illustrated in the electronic component 10*d*, in addition to the coil electrodes 20*a* to 20*e* that define the coil L2, each of the coil electrodes 18*a* to 18*e* that defines the coil L1 may also preferably have a length of a plurality of turns. Thus, an even higher inductance value and an even higher Q value are obtained with the electronic component 10*d* than with the electronic component 10*c*.

Fifth Preferred Embodiment

Figure 6:
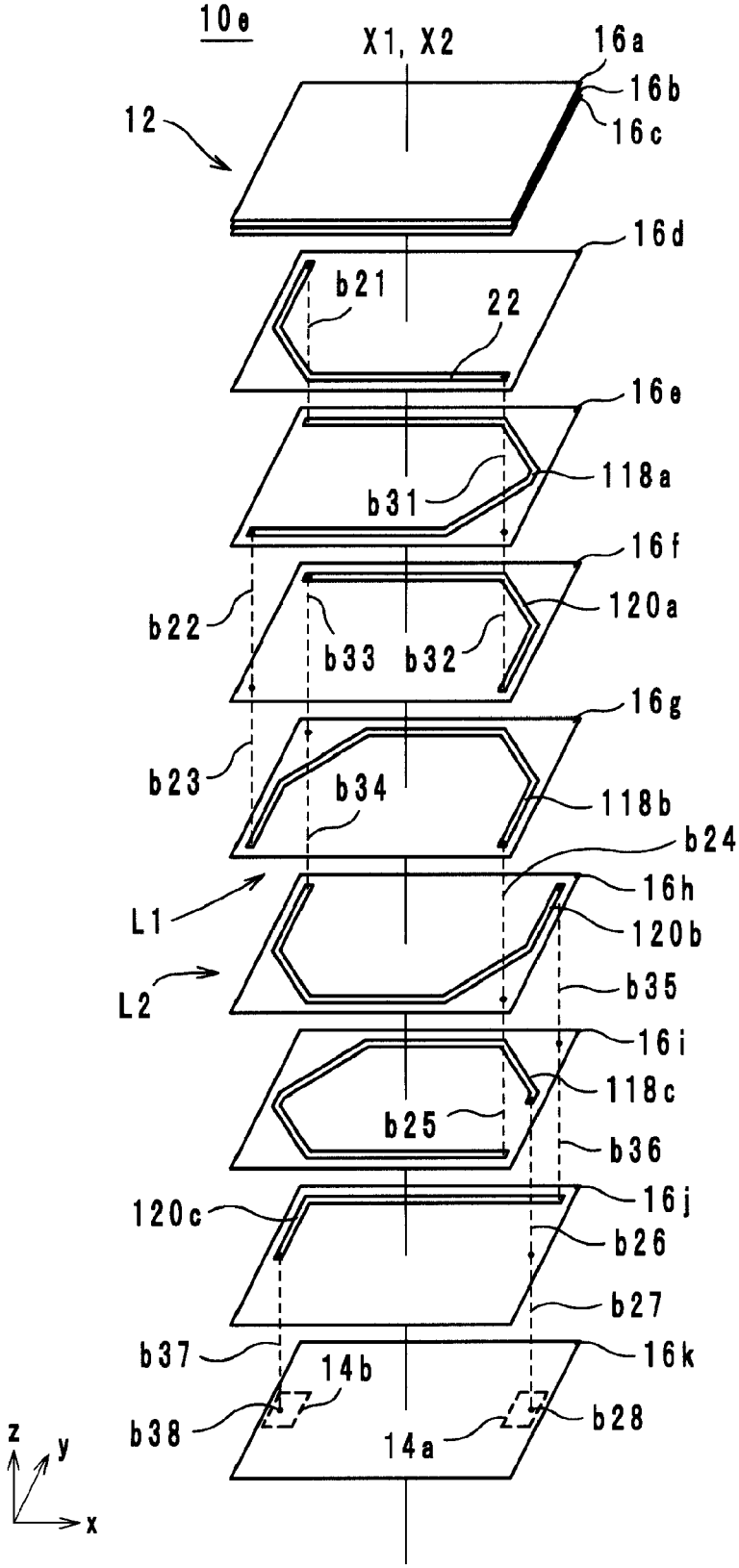
FIG. 6 is an exploded perspective view of an electronic component according to a fifth preferred embodiment of the present invention.

FIG. 6 is an exploded perspective view of an electronic component 10*e* according to a fifth preferred embodiment of the present invention. Hereafter, the stacking direction of the electronic component 10*e* is defined as a z-axis direction, a direction in which longer edges of the electronic component 10*e* extend is defined as an x-axis direction, and a direction in which shorter edges of the electronic component 10*e* extend is defined as a y-axis direction. The x-axis, the y-axis, and the z-axis are orthogonal to one another. Furthermore, FIG. 1 shows an external perspective view of the electronic component 10*e*.

In the electronic components 10*a* to 10*d*, the coil electrodes 18*a* to 18*e* are provided on the insulator layers 16*e* to 16*i* on which the coil electrodes 20*a* to 20*e* are provided. However, the method of arranging the coil electrodes is not limited to this.

Accordingly, in the electronic component 10*e*, coil electrodes 118*a* to 118*c* are preferably provided on the insulator layers 16*e*, 16*g* and 16*i*, which are different from the insulator layers 16*f*, 16*h* and 16*j* on which coil electrodes 120*a* to 120*c* are provided. In addition, the coil electrodes 118*a* to 118*c* and the coil electrodes 120*a* to 120*c* preferably have the same or substantially the same inner diameter and, therefore, face one another and are superposed with one another in the z-axis direction, when viewed in plan from the z-axis direction.

Furthermore, the coil electrodes 118*a* to 118*c* are preferably connected to one another through via hole conductors b22 to b27, thereby defining the coil L1. The coil electrodes 120*a* to 120*c* are preferably connected to one another through via hole conductors b33 to b37, thereby defining the coil L2.

In addition, the coil L1 and the coil L2 are preferably connected to each other through the connection electrode 22 and via hole conductors b21, b31 and b32. Furthermore, the coils L1 and L2 are preferably connected to the external electrodes 14*a* and 14*b* through via hole conductors b28 and b38, respectively. With the above-described configuration, the electronic component 10*e* illustrated in FIG. 6 includes a circuit configuration in which the coils L1 and L2 are connected in series with each other between the external electrodes 14*a* and 14*b*, in a similar manner as in the electronic component 10*a* illustrated in FIG. 2.

According to the electronic component 10*e*, the coil electrodes 118*a* to 118*c* are preferably provided on the insulator layers 16*e*, 16*g* and 16*i*, which are different from the insulator layers 16*f*, 16*h* and 16*j* on which the coil electrodes 120*a* to 120*c* are provided. Therefore, the coil electrodes 118*a* to 118*c* and the coil electrodes 120*a* to 120*c* do not intersect each other and, therefore, as illustrated in FIG. 6, the inner diameter of the coil L2 is the same or substantially the same as the inner diameter of the coil L1. As a result, the amount of magnetic flux that passes through the inside of the coil L2 can be increased in the electronic component 10*e* and, therefore, a high inductance value and a high Q value are obtained with the electronic component 10*e*.

Electronic components according to preferred embodiments of the present invention are not limited to those exemplified by the electronic components 10*a* to 10*e*. Therefore, the electronic components can be modified within the spirit and scope of the present invention.

In the electronic components 10*a* to 10*e*, all of the coil electrodes 18, 20, 118 and 120 preferably have the same line width, for example, but may, instead, have different line widths. For example, the line width of the coil electrodes 18 and the line width of the coil electrodes 20 may preferably be different from each other or the line widths of the coil electrodes 18 and 20 may preferably become larger or smaller as they extend from the negative side to the positive side in the z-axis direction. Furthermore, large-line-width coil electrodes 18 and 20 and small-line-width coil electrodes 18 and 20 may preferably be alternately arranged in the z-axis direction. In addition, the line widths of the coil electrodes 118 and 120 may be changed in the same or similar manner as those of the coil electrodes 18 and 20.

Furthermore, in the electronic components 10*a* to 10*e*, the coil electrodes 18, 20, 118 and 120 are arranged so as to be uniformly spaced in the z-axis direction but do not need to be disposed so as to be uniformly spaced.

In addition, in the electronic components 10*a* to 10*d*, all of the coil electrodes 18 are provided on the insulator layers 16 on which the coil electrodes 20 are provided. However, it is sufficient that at least one of the coil electrodes 18 is provided on an insulator sheet 16 on which a coil electrode 20 is provided.

Furthermore, in the electronic component 10*e*, all of the coil electrodes 118 are preferably provided on different insulator layers 16 from the insulator layers 16 on which the coil electrodes 120 are provided, for example. However, it is sufficient that at least one of the coil electrodes 118 is provided on an insulator layer 16 on which a coil electrode 120 is provided.

In addition, the numbers of turns of the coil electrodes 18, 20, 118 and 120 need not be ¾, and may be any suitable number of turns. Furthermore, the directions in which the coil electrodes 18, 20, 118 and 120 circle may be directions opposite to the described directions.

Preferred embodiments of the present invention are preferably suitable for use in electronic components and are particularly preferable because a high inductance value and a high Q value are obtained.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An electronic component comprising:

a multilayer body including a plurality of insulator layers stacked on top of one another in a stacking direction;

a first coil provided in the multilayer body, including a first coil axis, and extending in a first direction and circling in a predetermined direction around the first coil axis;

a second coil connected to the first coil, provided in the multilayer body, including a second coil axis, and extending in a second direction opposite to the first direction and circling in the predetermined direction around the second coil axis;

a first external electrode provided only on a surface of the multilayer body on a side of the multilayer body disposed in the second direction and connected to one end of the first coil; and a second external electrode provided only on the surface of the multilayer body on the side of the multilayer body disposed in the second direction and connected to one end of the second coil; wherein when viewed in plan from the first direction, the first coil axis is disposed inside the second coil, and when viewed in plan from the second direction, the second coil axis is disposed inside the first coil; and another end of the first coil disposed on a side of the multilayer body extending(?) in the first direction and another end of the second coil disposed on the side of the multilayer body extending(?) in the first direction are connected to each other.

2. The electronic component according to claim 1, wherein, when a current flows between the first external electrode and the second external electrode, when viewed in plan from the stacking direction, a direction in which current flows through the first coil and a direction in which current flows through the second coil are the same.

3. The electronic component according to claim 1, wherein the first coil includes a plurality of first coil electrodes that are provided on the plurality of insulator layers and connected to one another, the second coil includes a plurality of second coil electrodes that are provided on the plurality of insulator layers and connected to one another, and at least one of the plurality of first coil electrodes is provided on an insulator layer on which one of the plurality of second coil electrodes is provided.

4. The electronic component according to claim 1, wherein the first coil includes a plurality of first coil electrodes that are provided on the plurality of insulator layers and connected to one another, the second coil includes a plurality of second coil electrodes that are provided on the plurality of insulator layers and connected to one another, and at least one of the plurality of first coil electrodes is provided on an insulator layer on which none of the plurality of second coil electrodes is provided.

5. The electronic component according to claim 1, wherein a location of the first coil axis and a location of the second coil axis coincide with each other.

* * * * *